United States Patent [19]

Greiner et al.

[11] 4,237,079

[45] Dec. 2, 1980

[54] FUEL SUPPLY DEVICE

[75] Inventors: Max Greiner, Gerlingen; Klaus J. Peters, Affalterbach; Peter Schelthas, Stuttgart; Peter Stiefel, Ditzingen; Hermann Nusser, Asperg, all of Fed. Rep. of Germany

[73] Assignee: Robert Bosch GmbH, Stuttgart, Fed. Rep. of Germany

[21] Appl. No.: 105,437

[22] Filed: Dec. 19, 1979

Related U.S. Application Data

[63] Continuation of Ser. No. 901,673, May 1, 1978, abandoned.

[30] Foreign Application Priority Data

May 6, 1977 [DE] Fed. Rep. of Germany ..... 2720335

[51] Int. Cl.[3] ..... F02M 9/08

[52] U.S. Cl. ..... 261/44 A; 55/385 B; 55/280; 55/522; 261/44 G; 261/121 A

[58] Field of Search ..... 261/121 A, 121 B, DIG. 38, 261/44 A, 44 G; 55/385 B, 250, 524, 254, 280, 522

[56] References Cited

U.S. PATENT DOCUMENTS

| | | | |
|---|---|---|---|
| 1,994,766 | 3/1935 | Heglar | 55/254 |
| 2,816,573 | 12/1957 | Kaddis et al. | 261/DIG. 38 |
| 2,895,723 | 7/1959 | Wieland | 261/44 A |
| 3,033,911 | 5/1962 | Duddy | 55/524 |
| 3,394,533 | 7/1968 | Sheng Li et al. | 55/524 |
| 3,631,654 | 1/1972 | Riely et al. | 55/524 |
| 3,985,837 | 10/1976 | Rock | 261/DIG. 38 |
| 4,017,282 | 4/1977 | Zahka et al. | 55/524 |
| 4,071,040 | 1/1978 | Moriarty | 55/524 |
| 4,099,505 | 7/1978 | Stumpp | 261/44 A |
| 4,108,117 | 8/1978 | Stumpp et al. | 261/44 A |

FOREIGN PATENT DOCUMENTS

| | | | |
|---|---|---|---|
| 2233500 | 10/1975 | France | 261/DIG. 38 |
| 50-14034 | 4/1975 | Japan | 261/DIG. 78 |

OTHER PUBLICATIONS

Marks Mech. Engr. Handbook, 5th Ed., 1951, McGraw-Hill Co., p. 809.

*Primary Examiner*—Tim R. Miles
*Attorney, Agent, or Firm*—Edwin E. Greigg

[57] ABSTRACT

A fuel supply device is proposed which serves to supply fuel to a mixture-compressing, externally ignited internal combustion engine with a good distribution of the fuel-air mixture. The fuel supply device includes a fuel metering device activated by an air metering device arranged in the air intake manifold of the internal combustion engine with the fuel metering device being connected to an air line in which the metered fuel is mixed with air before the injection into the air intake manifold. Between the air line and the fuel line, upstream from the fuel metering position, a filter having a fine-meshed weave is arranged by means of which the fuel is prevented from flowing out over the air line in an undesirable manner.

6 Claims, 4 Drawing Figures

FUEL SUPPLY DEVICE

This is a continuation, of application Ser. No. 901,673, filed May 1, 1978 , now abandoned.

BACKGROUND OF THE INVENTION

The invention relates to a fuel supply device of the type described in the Greiner et al. application Ser. No. 897, 985 filed Apr. 20, 1978, now U.S. Pat. No. 4,175,102 and assigned to the assignee of this application.

OBJECT AND SUMMARY OF THE INVENTION

The fuel supply device according to the invention, has the advantage that the filter having a fine-meshed weave serves effectively and inexpensively to eliminate the undesired outflow of fuel over the air line, since the filter presents a barrier to the flow of fuel because of its large surface area, while on the other hand, air can easily pass through.

The invention will be better understood as well as further objects and advantages thereof become more apparent from the ensuing detailed description of the preferred embodiments taken in conjunction with the drawings.

DESCRIPTION OF THE PREFERRED EMBODIMENT

Figure 1:
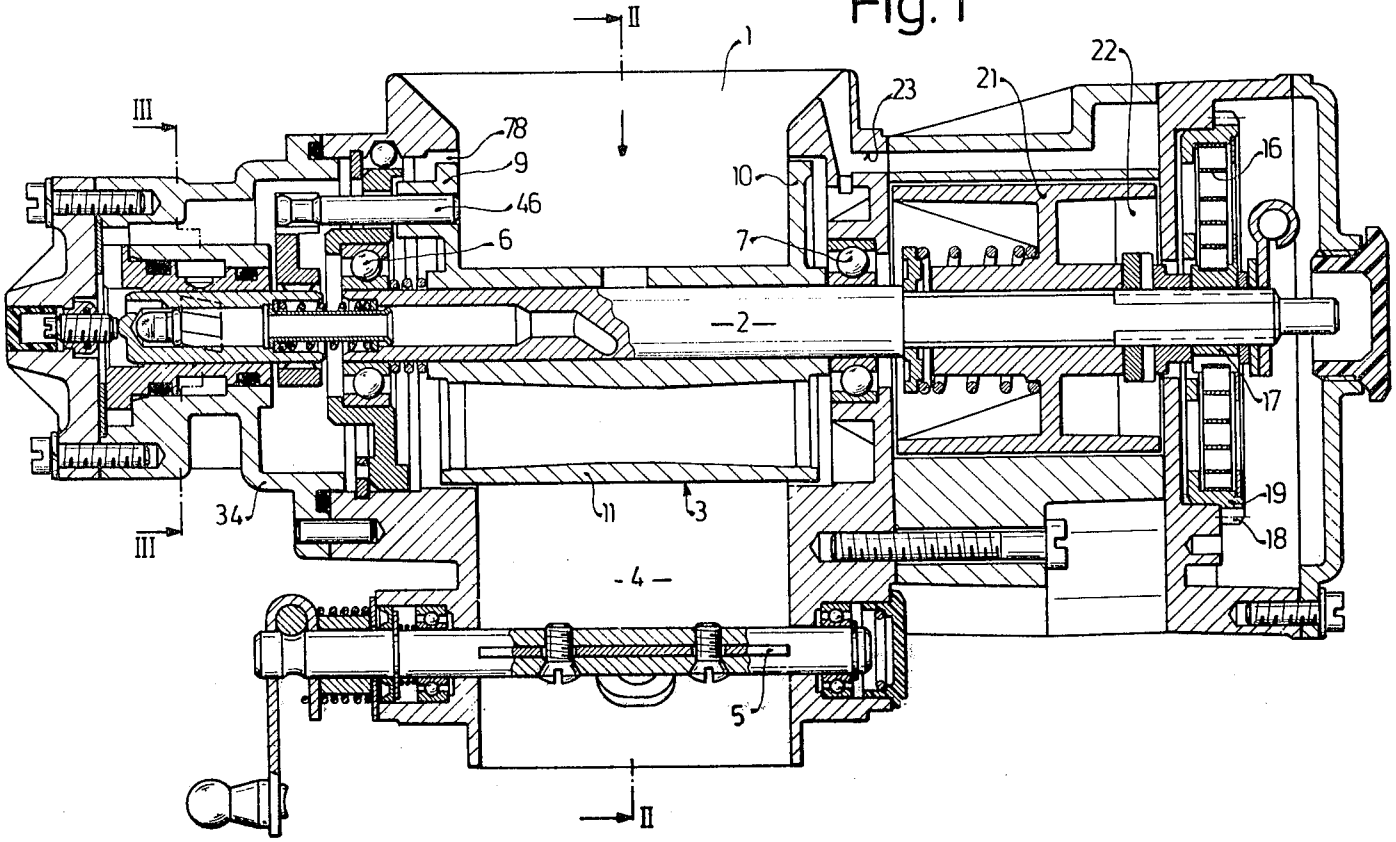
FIG. 1 shows a filter, according to the invention, arranged in a fuel supply device.
Figure 1A:
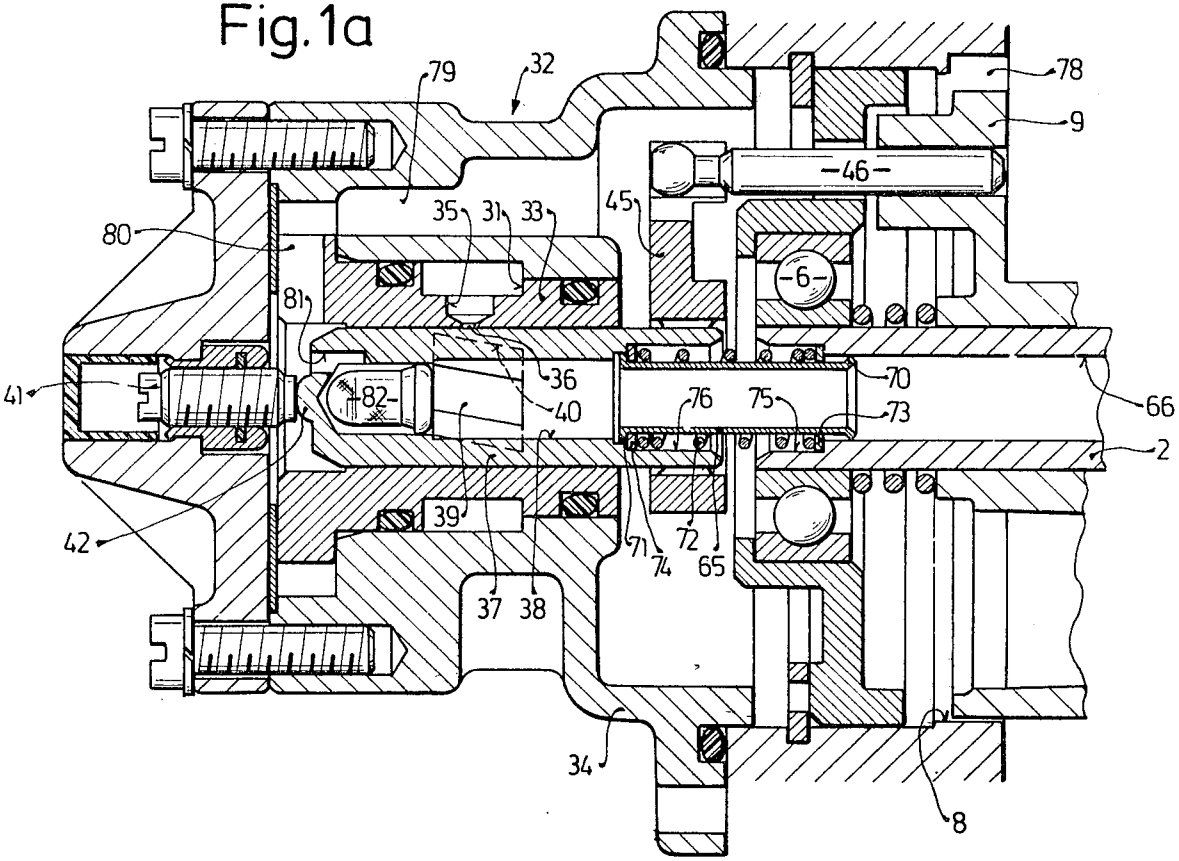
FIG. 1*a* is an enlarged sectional view of a portion of the fuel supply device shown in FIG. 1.

In the fuel supply device for a mixture compressing, externally ignited internal combustion engine shown in FIGS. 1 and 1*a*, the combustion air flows through an air filter (not shown) in the direction of the arrow into a section 1 of the air intake manifold, which contains a body 3 rotatably mounted on a shaft 2, which is formed as an air metering member and adapted for metering the air quantity aspirated by the internal combustion engine. The combustion air then flows through a section 4 of the intake manifold, which contains an arbitrarily activatable throttle valve 5 and into one or more cylinders (not shown) of the internal combustion engine. The hollow shaft 2, which is rigidly connected with the air metering member 3, is positioned in the wall of the air intake manifold section 1 by means of ball bearings 6 and 7. The air metering member 3 which includes oppositely disposed cylindrical end walls 9 and 10 is arranged to extend across the air intake manifold 1 and into these recesses as shown in FIG. 1. One such recess is indicated at 8 in FIG. 1*a*. The air metering member 3 also includes a cover section 11 that is adapted to control the flow cross section of the air intake manifold section 1.

Figure 2:
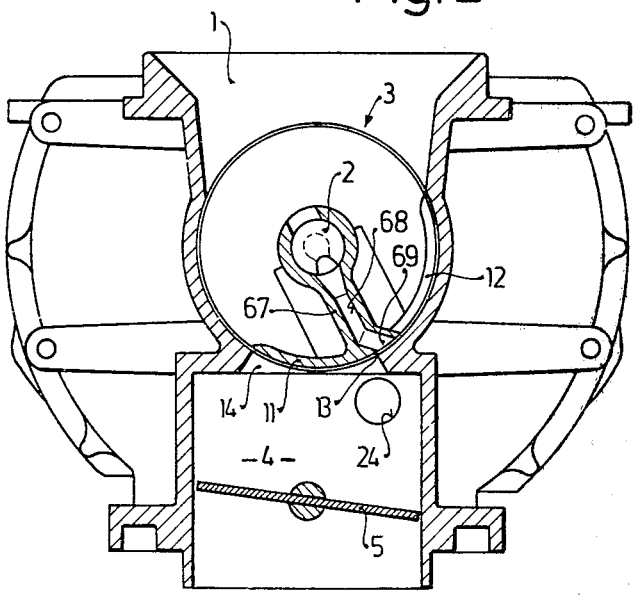
FIG. 2 is a sectional view along the line II—II of FIG. 1.

As shown in FIG. 2, a flow opening 12 having an air metering control edge 13 is machined into the cylindrical shell section 11 of the air intake manifold. The cylindrical shell section 11 of the air metering member 3 is formed in such a manner that the air intake manifold is closed by the shell section 11 when no air is flowing, and as the air aspiration rate increases, the air metering control edge 13 opens an aperture 14 of the air intake manifold to a greater degree. The cylindrical shell section 11 of the air metering member 3 is formed in such a manner that it completely blocks the aperture 14 when air is not flowing, but influences the air flow as little as possible in a position where the aperture 14 has been completely opened by the air meter control edge 13.

The clockwise deflection of the air meter member 3 takes place against the force of a spiral spring 16, which is connected on one of its ends with the mounting shaft 2 by means of a collar 17, and whose other end is connected with a ring 19, the exterior wall of which is provided with a toothed gear 18. The ring 19 can be rotated by a pinion member (not shown) that is arranged to cooperate with toothed gear 18, and can be arrested by setting screws which also are not shown.

Also connected with mounting shaft 2 of the air metering member 3 is a damping sleeve 21, which is adapted to rotate in an annular chamber 22, the movement of said sleeve arranged to correspond to the rotational movement of the air metering member 3. The area indicated at 22 is divided into two chambers by the damping sleeve and a radial barrier provided in the housing (not shown), with one of said chambers being arranged to communicate with the air intake manifold section 1 upstream of the air metering member 3 by means of a line 23, and the other chamber being arranged to communicate with the air intake manifold section 4 downstream of the air metering member by means of a line 24 and a throttling location (not shown). The arrangement of the damping sleeve 21 acts to damp the adjusting motion of the air metering member 3, so that the pressure fluctuations in th air intake manifold, which are caused by suction strokes, have practically no influence on the angular disposition of the air metering member 3. The air metering member 3 moves within the recess 8 of the air intake manifold section 1 according to a nearly linear function of the air quantity flowing through the air intake manifold. Thus, if the air pressure prevailing in front of the air metering member 3 remains constant, the pressure prevailing between the air metering member and the throttle valve 5 will also remain constant.

Figure 3:
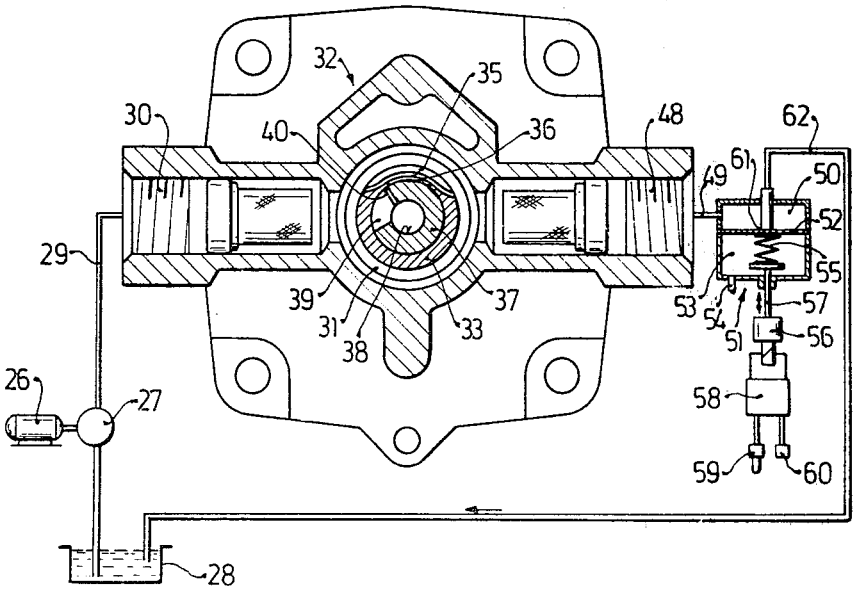
FIG. 3 is a sectional view along the line III—III of FIG. 1.

The fuel that is supplied to the fuel supply device takes place, as shown in FIG. 3, for example, by means of a fuel pump 27, which is driven by a electric motor 26, which pump aspirates the fuel from a fuel container 28 and leads it through a fuel supply line 29 to a nipple 30, and from there the fuel is fed into an annular groove 31 of the fuel metering device 32. The annular groove 31 is formed in a guide sleeve 33, which is rigidly mounted inside the housing 34 of the fuel metering device. The annular groove 31 communicates with a radial control slit 36 that is provided in the guide sleeve 33 by means of a supply recess 35. A rotatable sleeve 37, which has an inner bore 38 and a radially extending control groove 39, is mounted in the guide sleeve 33 so as to be capable of both rotational and slidable movement. The control groove 39 has at least one control edge 40, which opens the control slit 36 (FIG. 1*a*) to a greater or lesser degree depending on the position of the rotatable sleeve 37 relative to the guide sleeve 33. As shown by a broken line in FIG. 1*a*, the control edge 40 is formed at an angle to the central axis of the rotatable sleeve 37, so that the control slit 36 can be opened to a greater or lesser degree by the control edge 40 by means of an axial shifting of the rotatable sleeve 37 with regard to the guide sleeve 33. In this manner the basic setting of the fuel metering device 32 can be adjusted. The axial shifting of the rotatable sleeve 37 can be accomplished in very small increments by means of an adjusting screw 41, which is arranged to engage a nose portion 42 provided at a terminal end of the rotatable sleeve 37 with as little friction as possible. The rotatable sleeve 37 and the air metering member 3 are connected by a coupling comprising a carrier member 45 that is connected with the rotatable sleeve 37 by a carrier bolt 46 which in turn is connected with the perforated wall 9 of the air metering member 3, so that a quantity of fuel that is proportional to the aspirated air quantity is delivered at the control slit 36 during rotational movement of the air metering member 3. It is effective to allow the carrier bolt 46 to engage in the carrier member 45 with as great a distance from the axis of rotation as possible, so that errors of delivery caused by the unavoidable play between the carrier bolt and the carrier member remain as low as possible.

The fuel metering at the control slit 36 of the fuel metering device takes place with a constant pressure differential. For this purpose the annular groove 31 communicates with a chamber 50 (FIG. 3) of a differential pressure valve 51 by means of an outlet nipple 48 and a line 49. The chamber 50 of the differential pressure valve 51 is separated from a chamber 53 of the differential pressure valve by a diaphragm 52, with the differential pressure valve being arranged to communicate with the air intake manifold section 1 upstream of the air metering member 3 by means of a line 54. A spring 55 is arranged in the chamber 53 and acts on the diaphragm 52 in the closing direction of the differential pressure valve. The force of the spring 55 can be altered in dependence on operational values of the internal combustion engine. An electromagnet 56 can serve this purpose. For example, a support for the spring 55 may be engaged by means of an activating rod 57 or an additional force that is independent of operational values can act directly on the diaphragm 52 in a direction that is parallel to the spring 55. The electromagnet 56 can, for example, be turned on by means of an electronic control device 58 by a signal from an oxygen sensor 59 that is arranged in the exhaust gas line of the internal combustion engine to measure the oxygen partial pressure or by the signal of a temperature indicator 60. The control of the force on the diaphragm 52 could, for example, also take place by means of a bimetallic spring in dependence on the operational temperature of the internal combustion engine. The differential pressure valve 51 is formed as a flat seat valve, having the diaphragm 52 which includes a rigid valve set 61 as the movable valve element. Thus, with this arrangement excess fuel can flow into a return flow line 62, which empties into the fuel tank 28. The differential pressure valve simultaneously serves as the system pressure valve.

The fuel, which is metered at the control slit 36 of the fuel metering device 32, travels out of the inner bore 38 of the rotatable sleeve 37 through a connecting tubular member 65 into an axial bore 66 of the mounting shaft of the air metering member 3, and from there flows through a line 68, (FIG. 2) which runs in a radial barrier 67 to the cylindrical shell shaped section 11 of the air metering member, thence to a nozzle 69 in direct proximity to the air metering control edge 13, so that it can be injected into the flow cross section of the aperture 14 that is opened by the air metering control edge 13 where the greatest air flow speed is found. This results in an excellent spreading of the injected fuel. The connecting tube 65, which is mounted on one side in the inner bore 38 of the rotatable sleeve 37 and on the other side in the axial bore 66 of the mounting shaft 2, includes annular outwardly extending collars 70 and 71 on each of its ends and adjacent thereto are positioned discs 73 and 74 that are held in spaced relation by a pressure spring 72. The discs 73 and 74 are pressed against the collars 70 and 71 by the pressure spring 72 when they are not mounted in the fuel supply device. However, when the connecting tube 65 is mounted in the fuel supply device, the discs 73 and 74 are supported in abutting relation with the termini of the opposed bores 75 and 76 that are provided in the hollow shaft 2 and the rotatable sleeve 37, respectively. Thus, it will be understood that the discs 73 and 74 are urged by the pressure spring 72 against the stops provided by the end of the hollow shaft 2 and the rotatable sleeve 37. Accordingly, an excellent seal is assured with very little play despite the great freedom of movement allowed for the connecting tube 65. At the same time the rotatable sleeve 37 is axially fixed against the adjusting screw 41 that serves as a stop, all of which is accomplished by the force of the pressure spring 72.

To achieve an improved air-fuel mixture it is practical to add the fuel that is metered at the control slit 36 of the fuel metering device 32 into the manifold air through an air line before injection. For this purpose, air can travel from the air intake manifold section 1 upstream of the air metering member 3 through an opening 78 that is provided between the wall 9 of the air metering member 3 and the recess 8 into a bore 79 and a radial bore 80 of the fuel metering device 32 and from there flows into a longitudinal bore 81, which opens into the inner bore 38 of the rotatable sleeve 37. In order to prevent fuel from being inadvertently discharged from the system, especially under small pressure differentials and large fuel quantities, a filter 82 having a fine-meshed web is arranged in the inner bore 38. The filter 82 with its fine-meshed web provides an obstacle for the fuel because of the large surface constraint, but air can easily pass through the longitudinal bore 81. The filter web can, for example, be made of fine metal or plastic threads, the diameter of which is preferably 0.04 mm.; also, the distance from center to center of the material from which the filter is made is preferably 0.05 mm. The filter 82 thereby serves as an inexpensive and effective method of preventing the metered fuel from returning upstream, while also providing passage for air that is to be added to the fuel for an improved spreading thereof by means of an air line.

The foregoing relates to preferred exemplary embodiments of the invention, it being understood that other embodiments and variants thereof are possible within the spirit and scope of the invention, the latter being defined by the appended claim.

What is claimed and desired to be secured by letters patent of the United States is:

1. A fuel supply system for a mixture-compressing, externally ignited internal combustion engine having an air intake manifold for conducting a flow of combustion air, an arbitrarily activatable throttle member in said air intake manifold, an air metering member in said air intake manifold upstream of said throttle member for metering the quantity of air aspirated by said internal combustion engine, a fuel metering device for delivering a metered quantity of fuel proportional to the aspirated air quantity to said air metering member for mixing with said quantity of aspirated air, an air line connected to said air intake manifold upstream of said air metering member and to said fuel metering device for adding air to the metered fuel delivered to said air metering member and a filter having a fine-meshed web disposed upstream of the connection between said air line and said fuel metering device, said filter being adapted for filtering the flow of air therethrough and being impervious to fuel so as to prevent the reverse flow of fuel.

2. A fuel supply system as claimed in claim 1, wherein said fine-meshed web of the filter comprises strands having a diameter of approximately 0.04 mm.

3. A fuel supply system as claimed in claim 1, wherein said filter is formed from metallic strands.

4. A fuel supply system as claimed in claim 3, wherein the metallic strands each have a center that is approximately 0.05 mm. from the center of an adjacent metallic strand.

5. A fuel supply system as claimed in claim 1, wherein said filter is formed from plastic strands.

6. A fuel supply system as claimed in claim 2, wherein the plastic strands each have a center that is approximately 0.05 mm. from the center of an adjacent plastic strand.

* * * * *